US005938531A

United States Patent [19]

Yasushi et al.

[11] Patent Number: 5,938,531

[45] Date of Patent: Aug. 17, 1999

[54] INFORMATION REPRODUCING APPARATUS FOR USE WITH A PSYCHOLOGICAL GAME MACHINE

[75] Inventors: Mitsuo Yasushi; Satoshi Saitoh; Masatoshi Yanagidaira; Kazuhiro Akiyama, all of Kawagoe, Japan

[73] Assignee: Pioneer Electronic Corporation, Tokyo, Japan

[21] Appl. No.: 08/708,729

[22] Filed: Sep. 5, 1996

Related U.S. Application Data

[63] Continuation of application No. 08/347,140, Nov. 23, 1994, abandoned.

[30] Foreign Application Priority Data

Nov. 29, 1993 [JP] Japan ..... 5-298289

[51] Int. Cl.[6] ..... G06F 15/44

[52] U.S. Cl. ..... 463/36; 463/23

[58] Field of Search ..... 434/236, 237, 434/238; 600/26, 27; 273/148 B, DIG. 28; 463/36, 23, 43, 30

[56] References Cited

U.S. PATENT DOCUMENTS

| | | | |
|---|---|---|---|
| 4,149,716 | 4/1979 | Scudder | 273/438 |
| 4,571,682 | 2/1986 | Silverman et al. | 364/413 |
| 4,683,891 | 8/1987 | Cornellier et al. | 128/734 |
| 4,812,126 | 3/1989 | Gilliksen | 434/238 |
| 4,949,726 | 8/1990 | Hartzell et al. | 273/460 |
| 5,016,213 | 5/1991 | Dilts et al. | 364/410 |
| 5,024,235 | 6/1991 | Ayers | 128/732 |
| 5,362,069 | 11/1994 | Hall-Tipping | 273/460 |
| 5,377,100 | 12/1994 | Pope et al. | 364/410 |
| 5,395,110 | 3/1995 | Yamazaki et al. | 273/108 |

*Primary Examiner*—Jessica J. Harrison
*Assistant Examiner*—James Schaaf
*Attorney, Agent, or Firm*—Fish & Richardson P.C.

[57] ABSTRACT

An information reproducing apparatus applied to a psychological game machine which can evaluate the deep mental state of human, avoiding monotonous progress of a game. A plurality of image and audio information have previously been stored on a recording medium such that at least one of the plurality of image and audio information stored on the recording medium is selected for reproduction based on external operations and physiological changes in the body.

6 Claims, 15 Drawing Sheets

| ADDRESS REGION | STORED CONTENTS (UPPER) | (LOWER) |
|---|---|---|
| K | ATTRIBUTE OF PLAYER 1 | ATTRIBUTE OF PLAYER 2 |
| L | SELECTED GAME | |
| M | INITIAL PULSE RATE OF PLAYER 1 | INITIAL PULSE RATE OF PLAYER 2 |
| N | INITIAL RESPIRATION MATCHING DEGREE | |
| P | INTIAL GSR VALUE OF PLAYER 1 | INTIAL GSR VALUE OF PLAYER 2 |
| R | NUMBER OF FALSE ANSWERS OF PLAYER 1 | NUMBER OF FALSE ANSWERS OF PLAYER 2 |
| S | ANSWER OF PLAYER 1 | ANSWER OF PLAYER 2 |
| T | GSR VALUE OF PLAYER 1 | GSR VALUE OF PLAYER 2 |
| U | AFFINITY DEGREE | |
| W | QUESTION SELECTING REGISTER | |
| X | PULSE RATE OF PLAYER 1 | PULSE RATE OF PLAYER 2 |
| Y | PULSE RATE CHANGING RATIO OF PLAYER 1 | PULSE RATE CHANGING RATIO OF PLAYER 2 |
| Z | RESPIRATION MATCHING DEGREE | |

1: MAN
0: WOMAN
1: DEPTH PSYCHOLOGICAL GAME
0: AFFINITY FORECAST GAME

1: YES
0: NO

FIG. 8

| ADDRESS REGION | PLAYED CONTENS |
|---|---|
| 0A | "PLACE FINGERS ON SENSOR " IMAGE & SOUND |
| B1 | QUESTION FOR DEPTH PSYCHOLOGICAL GAME 1 |
| B2 | QUESTION FOR DEPTH PSYCHOLOGICAL GAME 2 |
| B3 | QUESTION FOR DEPTH PSYCHOLOGICAL GAME 3 |
| C1 | "IT'S A FALSE ANSWER, BOY!" IMAGE & SOUND |
| C2 | "IT'S A FALSE ANSWER, GIRL!" IMAGE & SOUND |
| D1 | EVALUATION FOR DEPTH PSYCHOLOGICAL GAME 1 |
| D2 | EVALUATION FOR DEPTH PSYCHOLOGICAL GAME 2 |
| D3 | EVALUATION FOR DEPTH PSYCHOLOGICAL GAME 3 |
| D4 | EVALUATION FOR DEPTH PSYCHOLOGICAL GAME 4 |
| E1 | QUESTION FOR AFFINIFY FORECAST 1 |
| E2 | QUESTION FOR AFFINIFY FORECAST 2 |
| F1 | EVALUATION FOR AFFINIFY FORECAST 1 |
| F2 | EVALUATION FOR AFFINIFY FORECAST 2 |
| F3 | EVALUATION FOR AFFINIFY FORECAST 3 |

FIG. 9

INFORMATION REPRODUCING APPARATUS FOR USE WITH A PSYCHOLOGICAL GAME MACHINE

This application is a continuation of U.S. application Ser. No. 08/347,140, filed Nov. 23, 1994, now abandoned.

BACKGROUND OF THE INVENTION

1. Field of the Invention

The present invention relates to an information processing apparatus applicable to a psychological game machine which tries to find mental states of game players.

2. Description of Background Information

As a method of evaluating a mental state of a human, there is known a method which repetitively gives interactive questions to a person to be evaluated, such as one which puts a leading question having a plurality of options to a person to be evaluated so as to have the person select one from the options, then puts another leading question in accordance with the selected option to the person, and so on, thus determining the person's deep mental state.

There is also known a psychological game machine which utilizes such a psychological evaluation method to try to find a mental state of a game player such that the player enjoys the progress of the game which may vary depending on his mental state.

The psychological game machine as mentioned above, however, may pose questions, the intention of which is substantially understood by the game player who may give a false answer so that the exact deep metal state of the game player is not determined. Also, the progress of the game may become so monotonous that the game player gets tired of the game.

OBJECT AND SUMMARY OF THE INVENTION

The present invention has been made to solve the problems mentioned above, and it is an object to provide an information reproducing apparatus applicable to a psychological game machine which is capable of exactly evaluating human's deep mental state while avoiding monotonous progress of a game.

An information reproducing apparatus according to the present invention has physiological change detecting means for detecting physiological changes in a body; storing means having a plurality of image and audio information stored thereon; operating means for generating an operation signal in response to an external operation; and information reproducing means for extracting at least one of the plurality of image and audio information stored on the storing means based on the physiological changes and the operation signal, and reproducing the extracted information.

A plurality of image and audio information are stored in a storing means, such that at least one of the plurality of image and audio information recorded on the storing means is extracted, based on external operations and physiological changes in a body, and the extracted information is reproduced.

BRIEF DESCRIPTION OF THE DRAWINGS

FIG. 8 shows a memory map in RAM 12;

FIG. 9 is a table showing the contents recorded on a recording disc in an LD player 9;

DETAILED DESCRIPTION OF THE PREFERRED EMBODIMENTS

Figure 1:
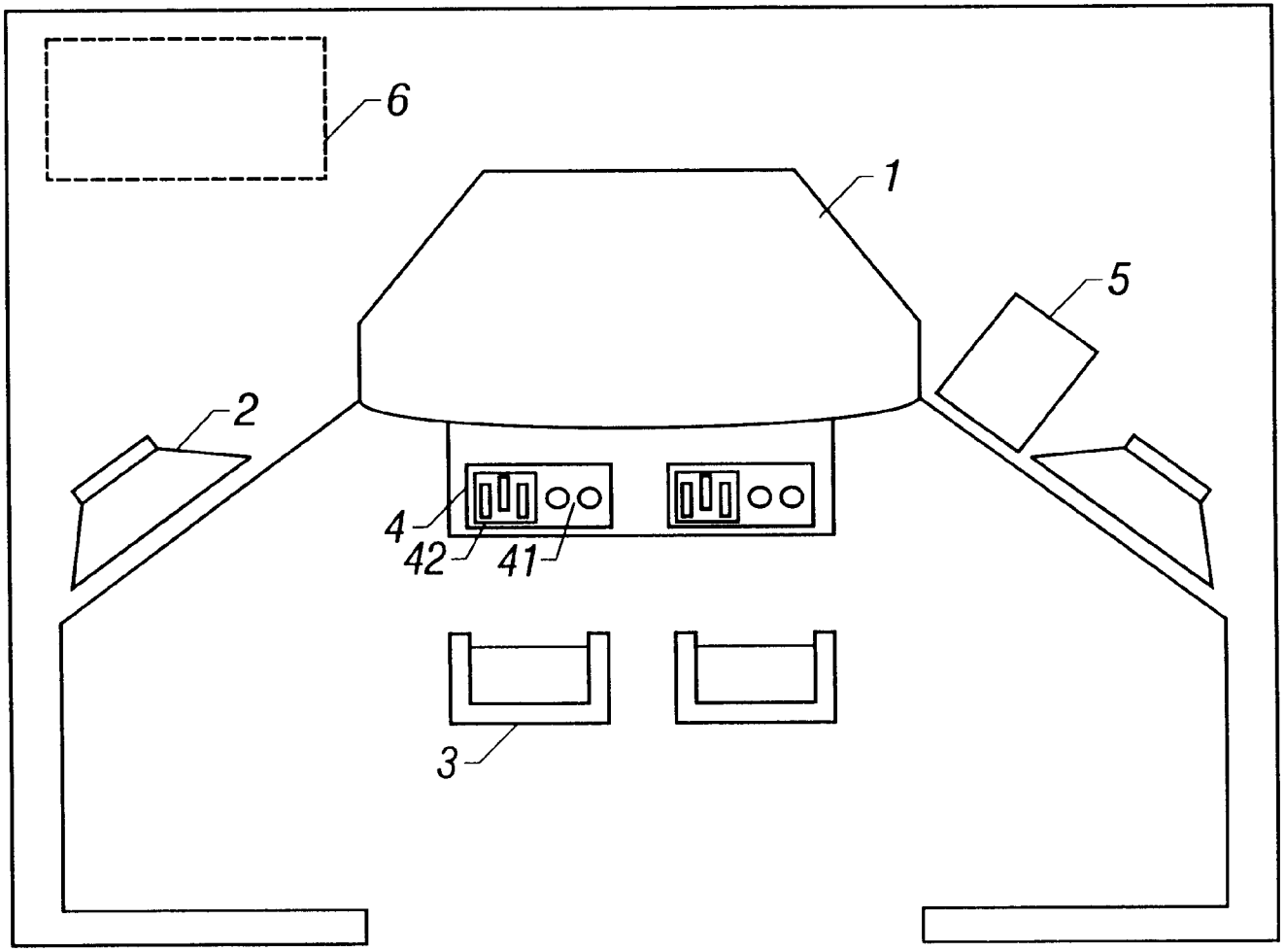
FIG. 1 is a top plan view showing the appearance of a psychological game machine to which an information reproducing apparatus according to the present invention is applied.

FIG. 1 shows the appearance of a psychological game machine to which an information reproducing apparatus according to the present invention is applied.

It can be seen from FIG. 1 that the psychological game machine is provided with a display 1 for displaying the progress and result of a game; a pair of speakers 2 for outputting music for the games and voice information; and an acoustic vibration chair 3 for giving mechanical vibrations in accordance with the acoustic output to a game player whose mental state is to be evaluated. A game player seated on the acoustic vibration chair 3 places his index finger, middle finger and medical finger on finger electrodes 42 arranged on an operation table 4 and depresses operation buttons 41 with his right hand at his will to progress the game. A printer 5 prints out an interim result in the middle of a play or the final result at the end of the play. A system controller 6 controls the operations of the display 1, the speakers 2, the acoustic vibration chair 3, the operation table 4 and the printer 5. It can be seen from FIG. 1 that the information reproducing apparatus of the invention is adapted to a game machine which is played by two game players so that the acoustic vibration chair 3 and the operation table 4 is provided for each of two players.

Figure 2:
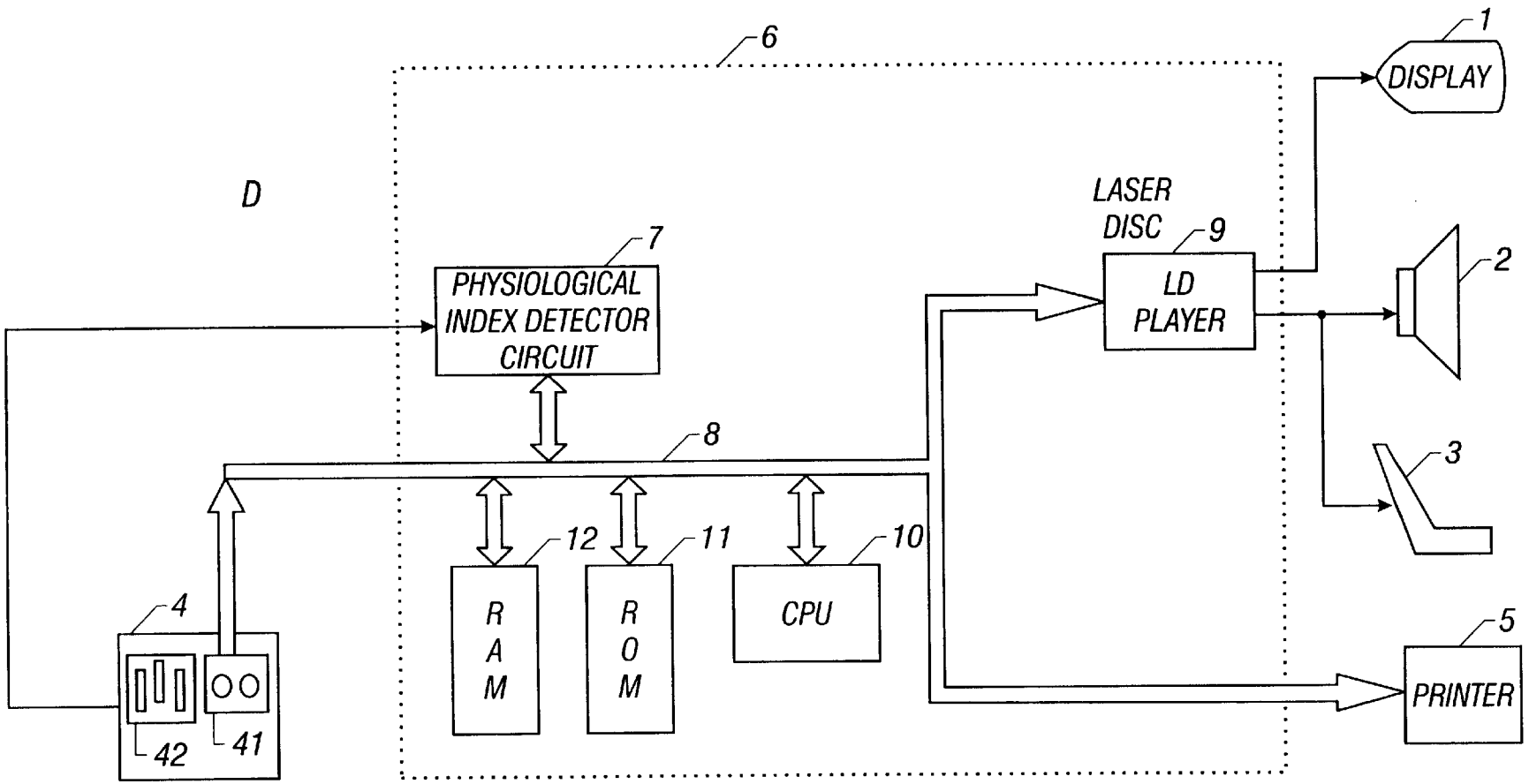
FIG. 2 is a block diagram showing the configuration of the information reproducing apparatus according to the present invention.

FIG. 2 shows the configuration of the information reproducing apparatus according to the present invention. Note that the same functional modules as those in FIG. 1 are designated the same reference numerals.

The operation table 4 supplies electrode signals generated by the above-mentioned finger electrodes 42 to a physiological index detector circuit 7 and generates a variety of operation signals, in response to depressing states of the operation buttons 41, which are supplied to a CPU bus 8. The physiological index detector circuit 7 detects the pulse rate, respiration and GSR (galvanic skin reflex) value of each player based on the electrode signals supplied from the finger electrodes 42 on the operation table 4, generates a pulse wave signal, a respiration wave signal and a GSR signal which are sent to the CPU bus 8 as physiological index signals. The physiological index detector circuit 7 further generates a detection signal for determining whether or not each player has his fingers placed on the finger electrodes 42, which is also sent to the CPU bus 8. The configuration composed of the finger electrodes 42 and the physiological index detector circuit 7 constitutes a physiological index sensor.

An LD (Laser Disc) player 9 is loaded with a recording disc on which video and audio signals are recorded for use in the progress of the game. The LD player 9 is responsive to a play command signal supplied thereto through the CPU bus 8 to play the recording disc to produce reproduced video and audio signals. The video signal reproduced by playing the disc is supplied to the display 1, while the reproduced audio signal is supplied to the speakers 2 and to the acoustic vibration chair 3, respectively. The LD player 9 is further responsive to an image control command signal supplied from the CPU bus 8 to adjust the image condition of the display 1. The printer 5 is responsive to a print-out command signal and a evaluation result information signal to print out information.

A CPU (Central Processing Unit) 10 reads a variety of signals sent onto the CPU bus 8 in accordance with an information reproducing apparatus operation procedure stored in a ROM (Read Only Memory) 11, and sends a variety of command signals to the LD player 9 and the printer 5 through the CPU bus 8. A RAM 12 stores various information generated in the course of the operation executed by the information reproducing apparatus.

Figure 3:
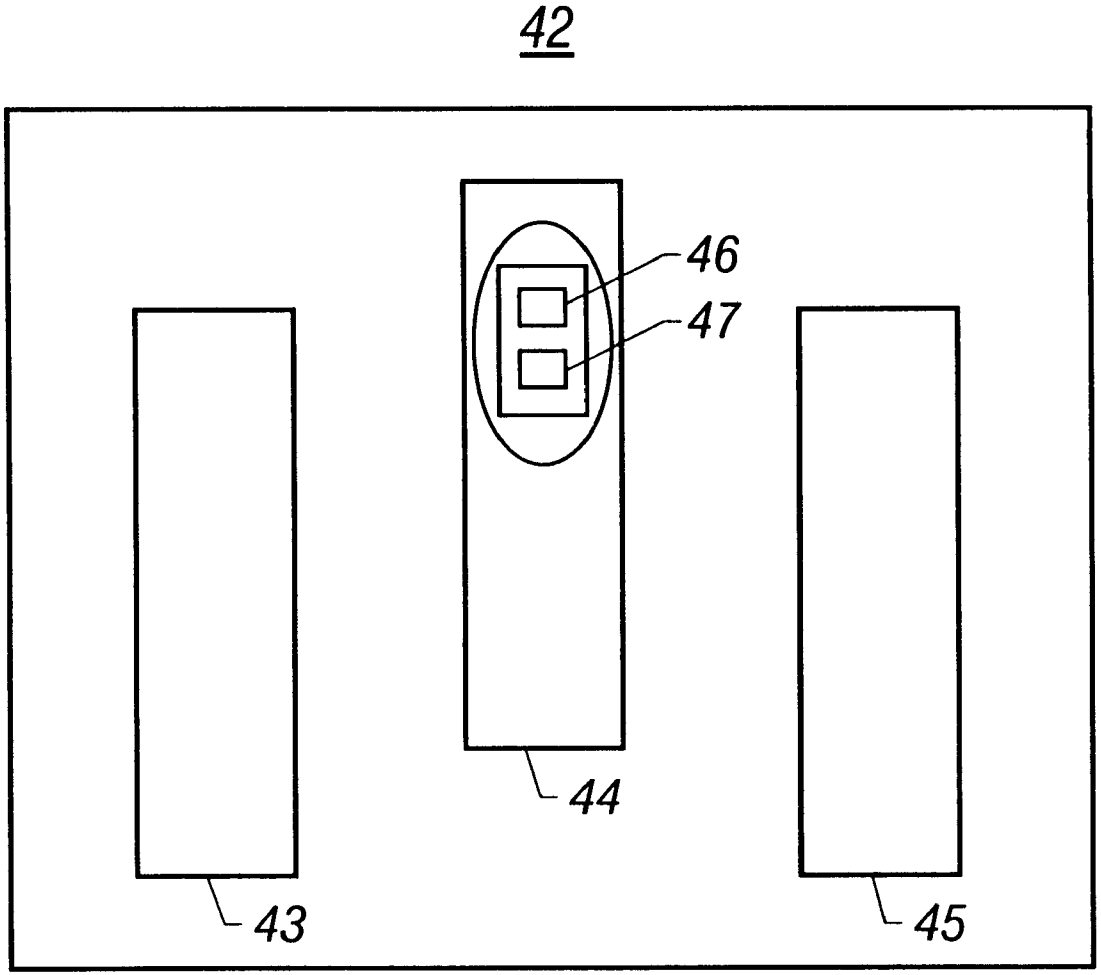
FIG. 3 is block diagram showing the configuration of finger electrodes 42.

FIG. 3 shows the configuration of the finger electrodes 42 arranged on the operation table 4. In the drawing, copper-foil electrodes 43, 44 and 45 have shapes suitable for placing the medical finger, middle finger and index finger, respectively. In a portion of the copper-foil electrode 44 on which a finger tip is placed, a light-emitting diode 46 and a photo-transistor 47 are arranged. The light-emitting diode 46 is positioned so as to irradiate the finger tip with infrared light or visible light. The photo-transistor 47 in turn is arranged with its light receiving surface directed to the finger tip in order to receive reflected light from the finger tip.

Figure 4:
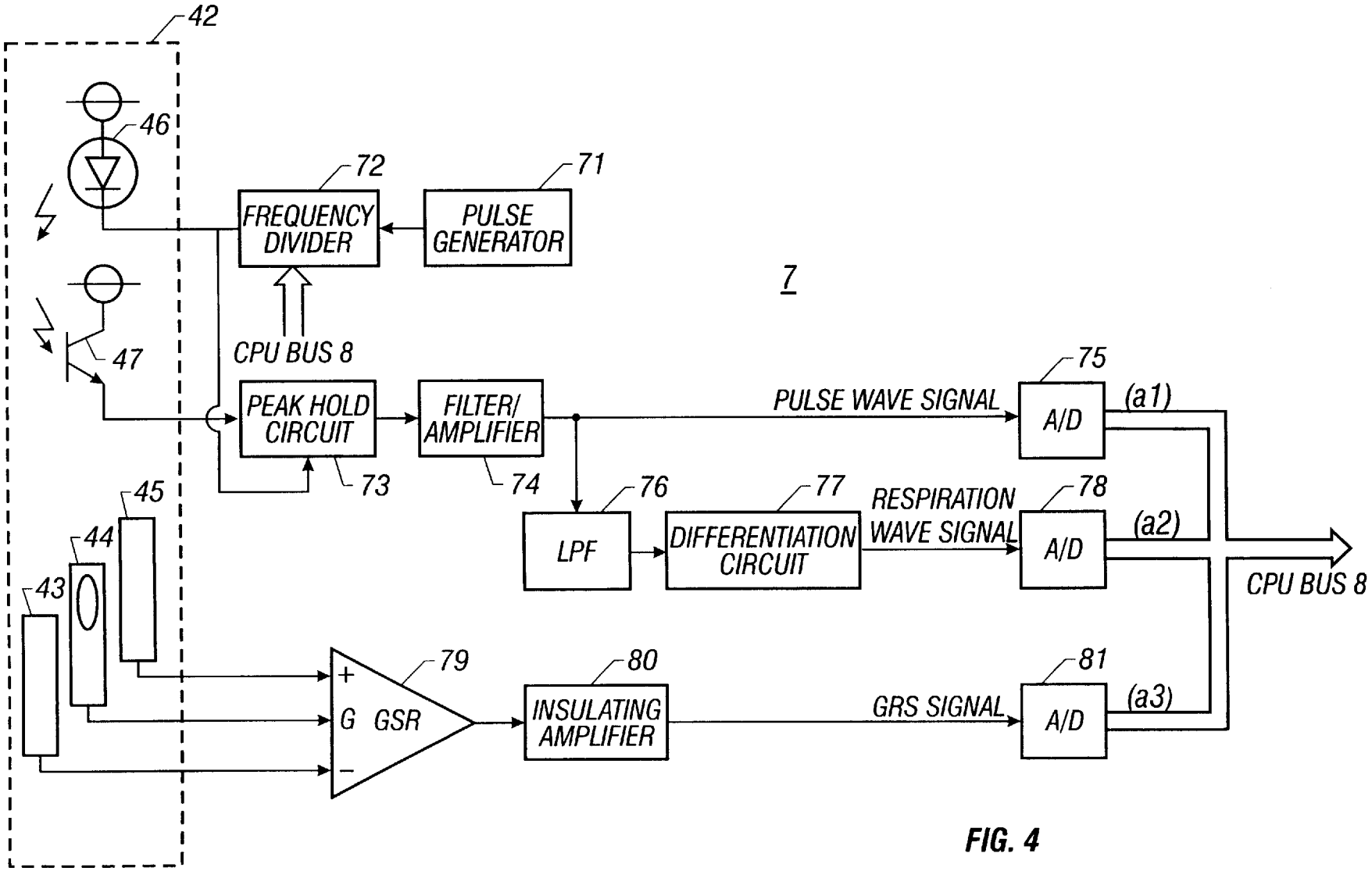
FIG. 4 is a circuit block diagram showing the configuration of a physiological index sensor.

FIG. 4 is a block diagram showing the configuration of the physiological index sensor composed of the finger electrodes 42 and the physiological index detector circuit 7.

Figure 5A:
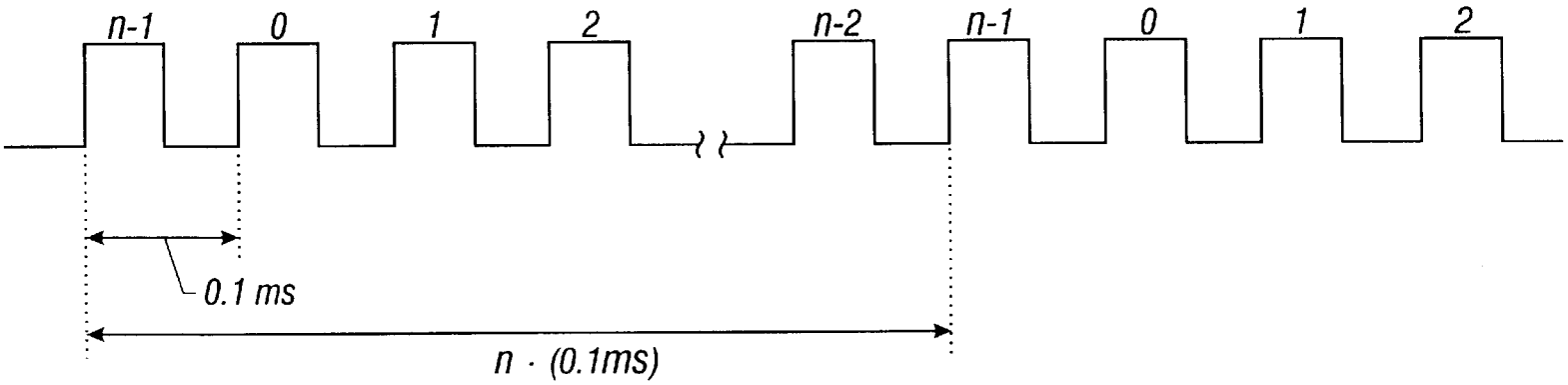
FIGS. 5A and 5B are timing charts showing the timing of output pulses generated from a pulse generator circuit 71.
Figure 5B:
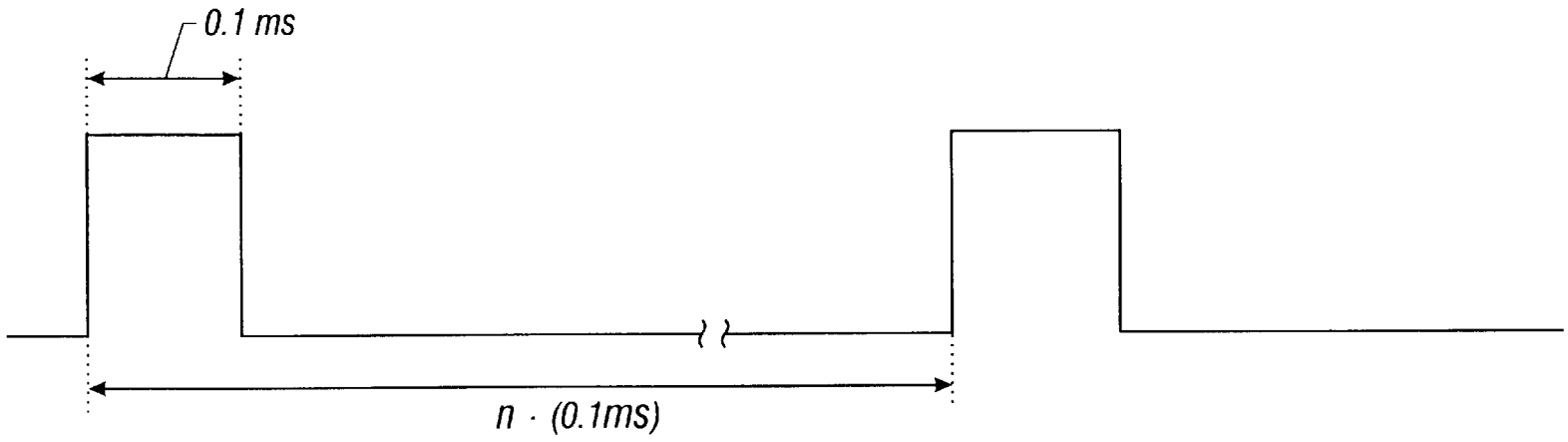

In the drawing, a pulse generator circuit 71 generates a pulse signal, for example, at 10 KHz and supplies the same to a frequency divider circuit 72. The frequency divider circuit 72 divides the pulse signal at 10 KHz supplied from the pulse generator circuit 71, as shown in FIG. 5A, by n in response to a 1/n division command signal to generate a divided pulse signal as shown in FIG. 5B which is supplied to the light-emitting diode 46 and a peak hold circuit 73 in the finger electrodes 42. In this event, the pulse duty ratio of the generated divided pulse signal shown in FIG. 5B is 1:n. The light-emitting diode 46 performs a pulsating light emission in response to the divided pulse signal to irradiate finger tips with infrared light or visible light. The irradiated light reflected from the finger tips reaches the light receiving surface of the photo-transistor 47.

The photo-transistor 47 converts the reflected light to an electric signal at a level corresponding to the magnitude of the reflected light and supplies the same to the peak hold circuit 73. The peak hold circuit 73 holds a peak level value of the electric signal supplied from the photo-transistor 47 at the timing of the divided pulse signal shown in FIG. 5B, and supplies a filter/amplifier 74 with a peak level signal corresponding to this peak value. The filter/amplifier 74, after removing noise components from the peak level signal and then amplifying the same in a desirable manner, supplies the processed signal to an A/D convertor 75 and an LPF (low pass filter) 76. In this event, the signal produced by the filter/amplifier 74 is a pulse wave signal corresponding to the pulse of a human or a game player. The A/D convertor 75 converts the pulse wave signal to a digital value formed of a predetermined number of bits which is assigned to a (a1) bit group of the CPU bus 8 and sent to the CPU bus 8. The LPF 76 extracts only low frequency components of, for example, 0.5 Hz or less in the pulse signal supplied from the filter/amplifier 74, and supplies the extracted signal components to the differentiation circuit 77. In this event, it can be said that the signal produced by the LPF 76 is a signal corresponding to the respiration of the human. The differentiation circuit 77 differentiates the signal supplied from the LPF 76, and supplies the differentiated signal to an A/D convertor 78. In this event, the signal produced by the differentiation circuit 77 is a respiration wave signal which represents a breathing-in state of the human when its signal level is minus and a breathing-out state of the human when it is plus level.

The A/D convertor 78 converts the respiration wave signal to a digital value formed of a predetermined number of bits which is assigned to a (a2) bit group of the CPU bus 8 and sent to the CPU bus 8. A GSR (galvanic skin reflex) detector 79 generates a signal which changes its level only when a potential change is detected in signals supplied from the copper foil electrodes 43, 44 and 45, and supplies the signal to an A/D convertor 81 through an insulating amplifier 80. Explaining in greater detail, the GSR detector 79 generates a signal which produces a level change, for example, such as a pulse signal, when detecting a small potential change on the skin which may occur if the human becomes tense, unrest, or the like, and supplies this signal to the insulating amplifier 80. The insulating amplifier 80 has power supply and GND (ground) lines insulated in its input and output systems. The insulating amplifier 80 prevents a high current from the power supply line from flowing into a human body through the copper foil electrodes 43, 44 an 45. The A/D convertor 81 converts a signal from the insulating amplifier 80 to a digital value formed of a predetermined number of bits which is assigned to a (a3) bit group of the CPU bus 8 and sent to the CPU bus 8.

Next, the operation of the psychological game machine shown in FIG. 1 will be explained by way of example.

The psychological game machine is adapted to provide game players with two kinds of games, for example, "dept psychological game" and "affinity forecast game" so as to allow the game players to selectively enjoy one of these games. The dept psychological game may be defined to be such a game that poses questions to game players so as to select either of "YES" or "NO" and tries to find the deep mental state of the respective game players in accordance of the answers selected by them. The affinity forecast game in turn may be defined to be such a game that poses the same questions to two game players and forecasts the affinity of the two players in accordance with their answers.

Figure 6:
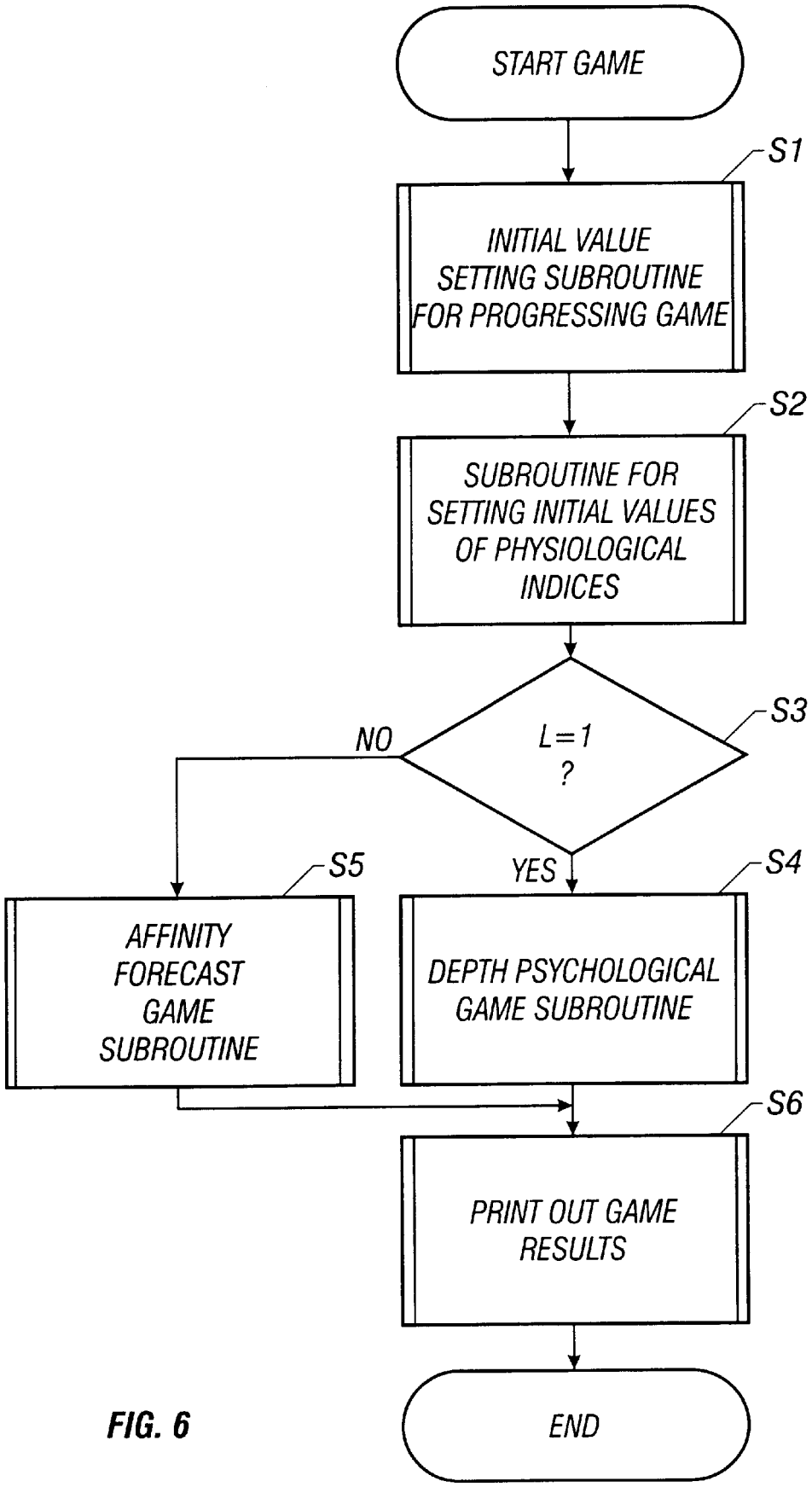
FIG. 6 is a flow chart showing the main operation of the psychological game machine.

FIG. 6 shows a flow chart showing a main operation of the psychological game machine executed by the CPU 10.

First, each of game players depresses the operation buttons 41 arranged on the operation table 4 to instruct the game machine to start a game. The CPU 10 responsively enters the execution of step S1 in an initial value setting subroutine for progressing a game.

Figure 7:
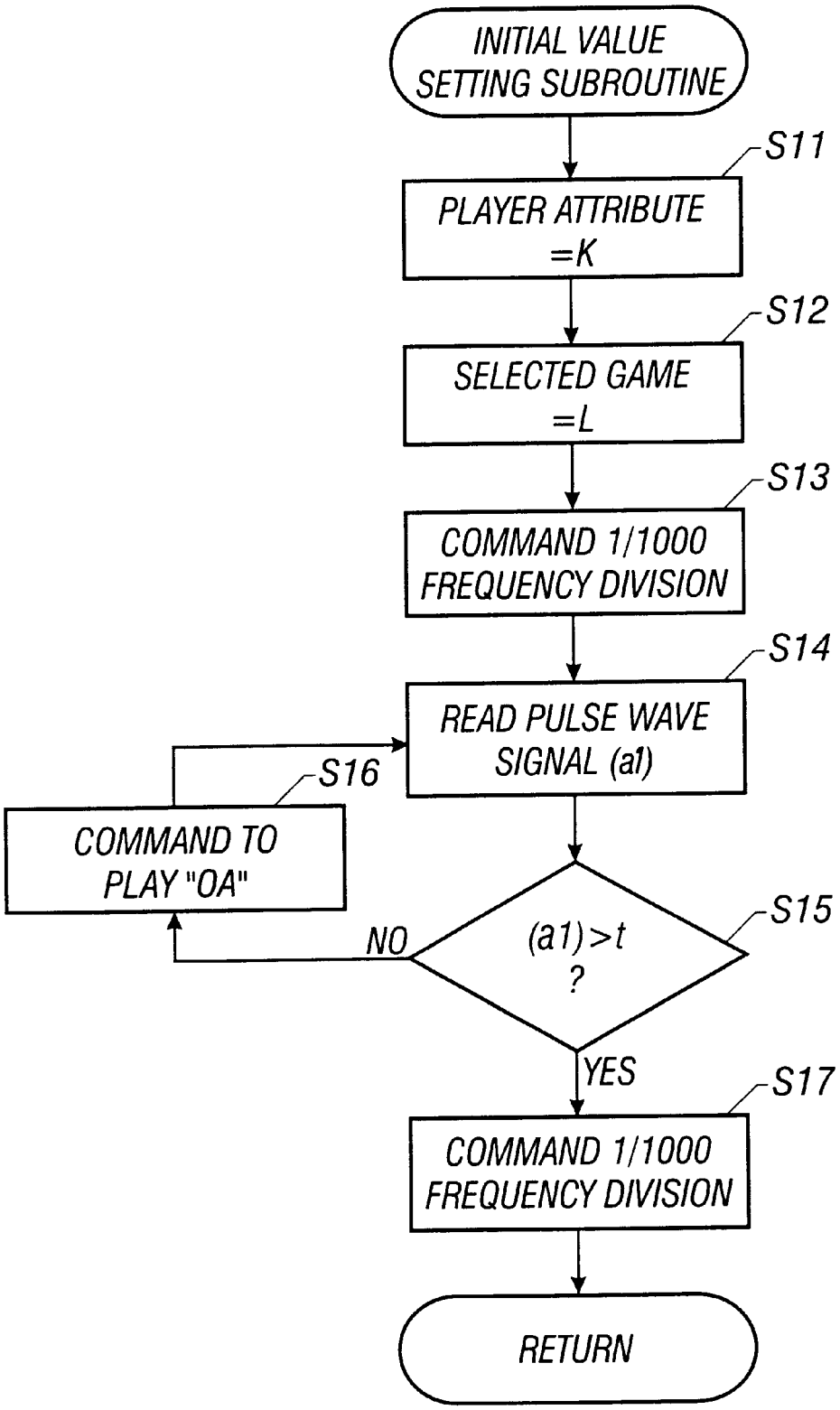
FIG. 7 is a flow chart showing an initial value setting subroutine in the psychological game machine.

FIG. 7 shows the flow of the initial value setting subroutine for progressing a game.

First, each of game players specifies a player attribute as to whether the player is "man" or "woman" and makes a game selection as to which of the "affinity forecast game" and the "dept psychological game" the player desires to play by depressing the operation buttons 41 arranged on the operation table 4. In this event, if "man", for example, is specified as the game player attribute, an attribute specifying operation signal at logical "1" is sent from the operation table 4 to the CPU bus 8, while the attribute specifying signal at logical "0" is sent from the operation table 4 to the CPU bus 8 if "woman" is specified. Further, if the "dept psychological game" is selected as a game the player desires to play, a play game selection signal at logical "1" is sent from the operation table 4 to the CPU bus 8, while the play game selection signal at logical "0" is sent from the operation table 4 to the CPU bus 8 if the "affinity forecast game" is selected.

The CPU 10, responsive to the operations as described above, first stores the attribute specifying signals of two game players into an address region K in the RAM 12 as shown in FIG. 8 (step S11). In this event, as shown in FIG. 8, the attribute specifying signal of a game player "1" is stored on the upper side of the region, and the attribute specifying signal of a game player "2" is stored on the lower side of the region. Next, the CPU 10 stores the play game selection signal into an address region L in the RAM 12 as shown in FIG. 8 (step S12). Then, the CPU 10 supplies the frequency divider circuit 72 in the physiological index detector circuit 7 with a 1/1000 division command signal in order to have the frequency divider circuit 72 execute 1/1000 frequency division (step S13). By the execution of step S13, the frequency divider circuit 72 divides a pulse signal at 10 KHz supplied from the pulse generator circuit 71 by 1000 in response to the division command signal, and supplies the divided pulse signal at 10 Hz having the pulse duty ratio of 1:1000 to the light-emitting diode 46 in the finger electrodes 42.

The CPU 10 next reads the (a1) bit group, i.e, a digitized pulse wave signal (a1) on the CPU bus 8 sent from the physiological index detector circuit 7 (step S14), and determines whether or not the value of the pulse wave signal (a1) is larger than a predetermined value t (step S15). In this event, if the player has fingers placed on the finger electrode 42, the photo-transistor 47 is irradiated with light reflected by the fingers, resulting in generating the pulse wave signal (a1) having a value larger than the predetermined value t. On the other hand, if the game player does not place fingers on the finger electrodes 42, the photo-transistor 47 is not irradiated with reflected light, so that the value of the pulse wave signal (a1) is smaller than the predetermined value t.

If determining at step S15 that the value of the pulse wave signal (a1) is not larger than the predetermined value t, the CPU 10 supplies the LD player 9 with a play command signal for having the LD player 9 play the contents recorded in an address region "0A" on a recording disc as shown in FIG. 9 (step S16). In the address region "0A" on the recording disc, a message for instructing the game player to place fingers on the finger electrodes 42 is recorded in the form of video and audio signals. By the execution of the foregoing step S16, the contents of the message is displayed on the display 1, while a speech in accordance with the contents of the message is acoustically output from the speakers 2. It should be noted that a unique character (person, animal or the like) may also be displayed in addition to literal information as described in the address region "0A".

Upon completing step S16, the CPU 10 returns to step S14, and repetitively executes the operations as described above until the value of the pulse wave signal (a1) is determined to be larger than the predetermined value t at step S15. At step S15, if determining that the value of the pulse wave signal (a1) is larger than the predetermined value t, the CPU 10 supplies the frequency divider circuit 72 in the physiological index detector circuit 7 with a 1/100 division command signal for having the frequency divider circuit 72 execute 1/100 frequency division (step S17). The execution of step S17 causes the frequency divider circuit 72 to divide a pulse signal at 10 KHz supplied from the pulse generator circuit 71 by 100 in response to the division command, and supplies the light-emitting diode 46 in the finger electrodes 42 with the divided pulse signal at 100 Hz having the pulse duty ratio of 1:100, generated in the foregoing manner.

By the execution of the foregoing steps S14, S15, it is determined whether or not the game player has fingers placed on the finger electrodes 42. If determination is made that fingers are not placed on the finger electrodes 42, step S16 is executed to instruct the game player to place fingers on the finger electrodes 42. Thereafter, when the game player has placed fingers on the finger electrodes 42, step S17 is executed to initially set the physiological index detector circuit 7 itself (the frequency divider circuit 72 is fixed to the 1/100 frequency division operation). It should be noted that since the frequency divider circuit 72 is commanded to divide the pulse signal by 1000 at step S13, power consumption is reduced during the execution of steps S14, 15 and 16.

After the execution of the foregoing step S17, the CPU 10 exits the initial value setting subroutine for progressing the game and returns to the main operation flow of FIG. 6, and proceeds to the execution of a subsequent subroutine for setting initial values of physiological indices at step S2.

Figure 10:
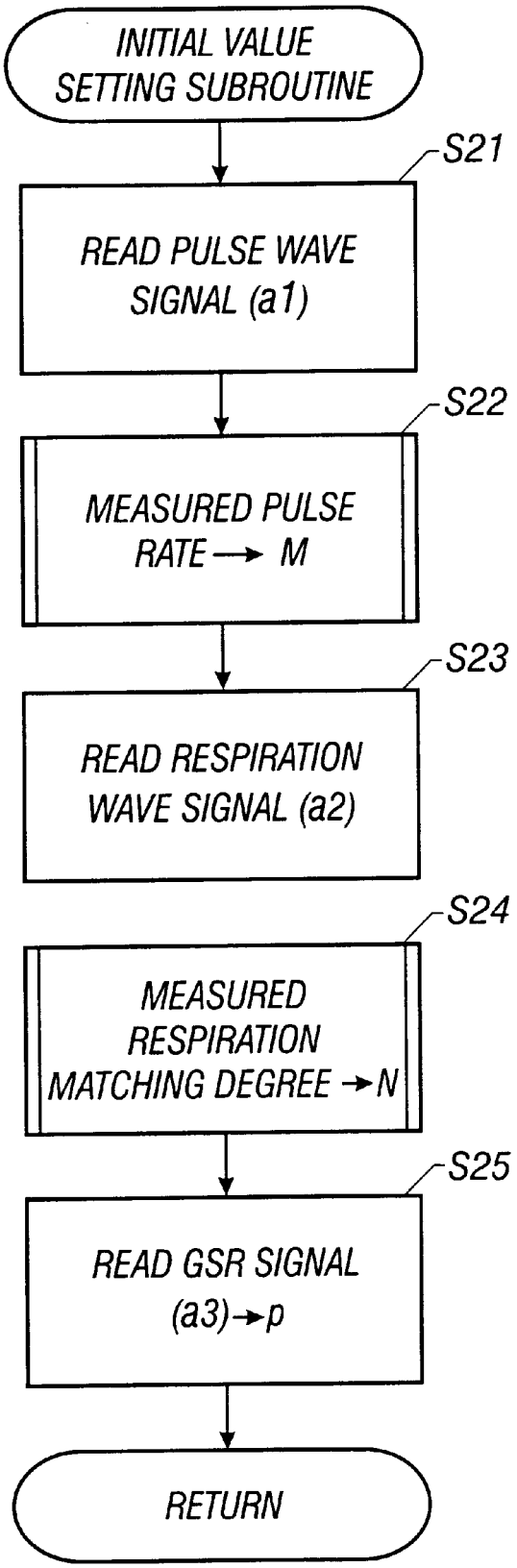
FIG. 10 is a flow chart showing a subroutine for setting initial values of physiological indices.

FIG. 10 shows a flow of the subroutine for setting initial values of physiological indices as mentioned above.

The CPU first reads respective pulse wave signals (a1) of the game player "1" and the game player "2" sent from the physiological index detector circuit 7 during a predetermined time period T, and stores respective values of the pulse wave signals (a1) read during the period T into a predetermined address region in the RAM 12 (step S21). Next, the CPU 10 calculates the pulse rate for each of the game players "1" and "2" per unit time, based on the respective values of the pulse wave signals (a1) stored in the predetermined address region of the RAM 12 and the above-mentioned predetermined time period T, and stores the calculated pulse numbers into an address region M in the RAM 12 as shown in FIG. 8 as initial pulse numbers of the respective game players "1" and "2" (step S22).

The CPU 10 next reads respiration wave signals (a2) of the respective game players "1" and "2" sent from the physiological index detector circuit 7 during a predetermined time period, and stores respective values of the respiration wave signals (a2) read during this period into a predetermined address region in the RAM 12 (step S23). Next, the CPU 10 subtracts the respiration wave signals (a2) of the respective game players "1" and "2" stored in the predetermined address region in the RAM 12 which have been fetched at the same timing, calculates the total sum of absolute values of differences derived by this subtraction, and stores this total sum as an initial respiration matching degree into an address region N in the RAM 12 as shown in FIG. 8 (step S24). Stated another way, if the respirations of the game players "1" and "2" completely match with each other, the difference between the respective respiration wave signals (a2) fetched at the same timing will result in "0", so that the total sum of absolute values of the differences will also present "0". On the other hand, as the respirations of the game players "1" and "2" deviate larger, the total sum of absolute values of the differences is increased. In summary, the initial respiration matching degree is a small value if the respirations of the game players "1" and "2" substantially match with each other, while the initial respiration matching degree is large if a significant deviation is found between the respirations of the game players "1" and "2".

Next, the CPU 10 reads GSR signals (a3) of the respective game players "1" and "2" sent from the physiological index detector circuit 7, and stores them as initial GSR values into an address region P in the RAM 12 as shown in FIG. 8 (step S25).

After the execution of step S25, the CPU 10 exits the subroutine for setting initial values of the physiological indices as described above and returns to the main operation flow of FIG. 6.

Referring back to FIG. 6, the CPU 10 reads the contents stored in the address region L in the RAM 12 of FIG. 8 and determines whether or not the stored contents indicate "1" (step S3). If it is determined at step S3 that the stored contents indicate "1", the CPU 10 proceeds to the execution of a subroutine for executing the depth psychological game at step S4.

Figure 11:
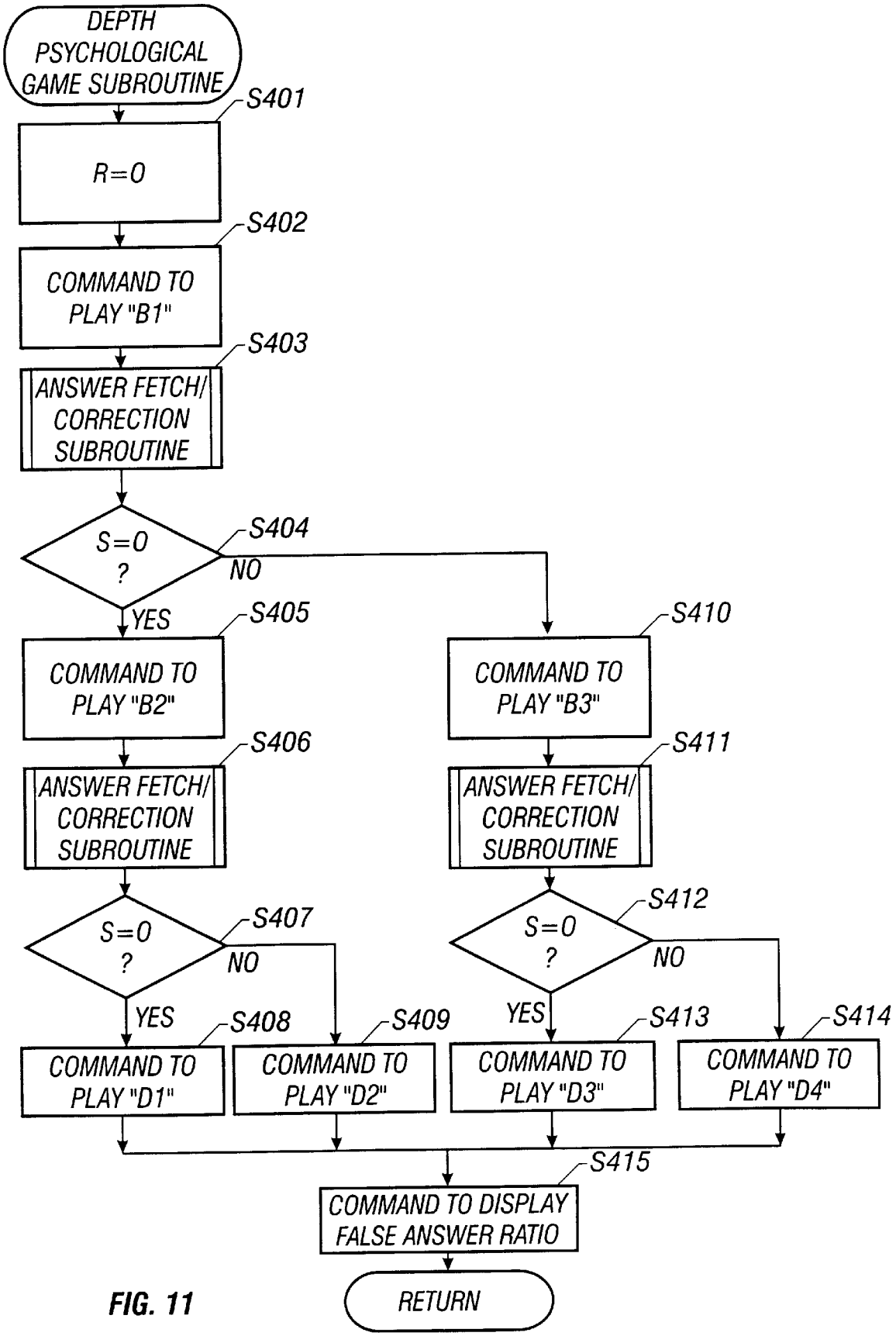
FIG. 11 is a flow chart showing a depth psychological game subroutine in the psychological game machine.

FIG. 11 shows a flow of the depth psychological game subroutine.

The CPU 10 first resets the contents of an address region R in the RAM 12 of FIG. 8 to "0" (step S401). This means that step S401 sets the number of false answers for the game players "1" and "2" to an initial value equal to "0". The CPU 10 next supplies the LD player 9 with a play command signal for having the LD player 9 play the contents recorded in an address region "B1" on a recording disc as shown in FIG. 9 (step S402). Recorded in the address region "B1" on the recording disc is a first leading question for progressing the depth psychological game in the form of video and audio signals. By the execution of step S402, the contents of the leading question is displayed on the display 1 and acoustically output from the speakers 2. After the execution of this operation, the CPU 10 proceeds to the execution of an answer fetch/correction subroutine at step S403.

Figure 12:
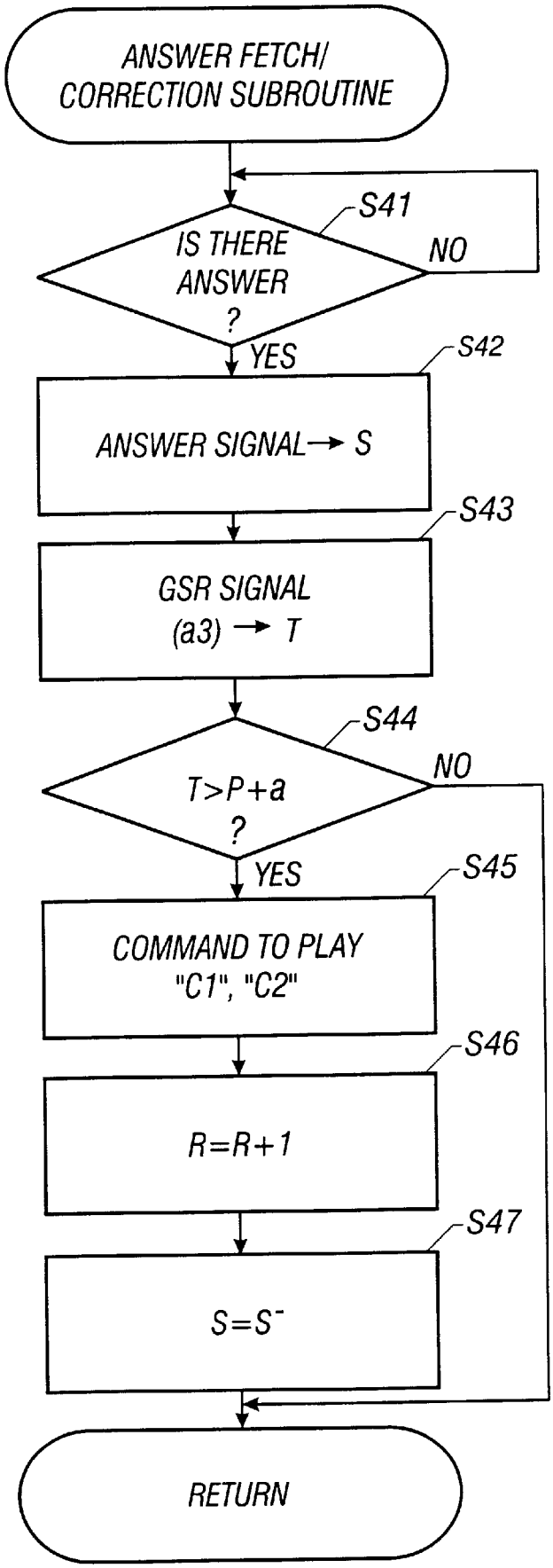
FIG. 12 is s flow chart showing an answer fetch/correction subroutine in the psychological game machine.

FIG. 12 shows a flow of the answer fetch/correction subroutine.

The CPU 10 first determines based on the states of signals from the operation buttons 41 whether or not the game players have answered to the first leading question. This operation is repetitively executed until the game players give answers to the game machine (step S41). In this event, when each of the game players depresses the operation button to answer "YES" or "NO" in order to answer the displayed leading question, the CPU 10 stores a signal corresponding to the answer, for example, logical "1" when the answer is "YES" and logical "0" when the answer is "NO", into an address region S in the RAM 12 as shown in FIG. 8 (step S42). The CPU 10 next reads GSR signals (a3) sent from the physiological index detector circuit 7 and stores them into an address region T in the RAM 12 as shown in FIG. 9 (step S43). Then, the CPU 10 determines whether or not the GSR value for each of the game players stored in the address region T is larger than the sum of the initial GSR value stored in the address region P in the RAM 12 and a predetermined value a (step 44). If it is determined at step S44 that the GSR value stored in the address region T is larger than the sum of the initial GSR value stored in the address region P in the RAM 12 and the predetermined value a, the CPU 10 supplies the LD player 9 with a play command signal for having the LD player 9 play the contents stored in an address region "C1" or "C2" on the recording disc as shown in FIG. 9 (step S45).

At step S45, the CPU 10 determines the game player attribute (man or woman) by reading the address region K in the RAM 12. In this event, if the game player "1" or "2" is determined to be, for example, a man, the LD player 9 is supplied with a play command signal for having the LD player 9 play the contents recorded in the address region "C1" on the recording disc as shown in FIG. 9. Conversely, if the game player "1" or "2" is determined to be a woman, the LD player 9 is supplied with a play command signal for having the LD player 9 play the contents recorded in the address region "C2". After the completion of step S45, the CPU 10 adds "1" to the number of false answers for the game player "1" or "2" stored in the address region R (step S46), and inverts the logical state of the value indicating the answer of the game player "1" or "2" (step S47). After the execution of step S47, or if determining at step S44 that the GSR values stored in the address region T are not larger than the sum of the initial GSR value stored in the address region P in the RAM 12 and the predetermined value a, the CPU 10 exits the answer fetch/correction subroutine.

Explaining in another way, the foregoing answer fetch/correction subroutine first fetches the answers of the game players to the displayed leading question (step S42), and measures the GSR values as a physiological index of the game players (step S42). Then, the measured GSR values are respectively compared with the initial GSR value measured prior to the start of the game to determine whether each of the game players has given a false answer to the question (step S44). In this event, if it is determined that one of the game players has given a false answer, the game player is presented a message pointing out that he or she has lied, such as the contents recorded in the address regions "C1" or "C2" shown in FIG. 9, as stimulation (step S45). Further, the contents of the address region R in the RAM 12, serving as a false number counter, is incremented by one (step S46), and in order to correct the answer determined as false, the answer of the game player fetched at step S42 is inverted to derive a corrected answer (step S47). The CPU 10 exits the answer fetch/correction subroutine to return to the flow of the depth psychological game subroutine which the CPU 10 was executing immediately before the start of the answer fetch/correction subroutine, after completing the correction operation, or when the CPU 10 determines at step S44 that the game players have not given a false answer.

Referring again to FIG. 11, after completing the execution of the answer fetch/correction subroutine at step S403, the CPU 10 determines whether or not each of the values stored in the address region S in the RAM 12 indicating the answers of the game players is "0" (step S404). If determining at step S404 that the value is "0", the CPU 10 supplies the LD player 9 with a play command signal for having the LD player 9 play the contents stored in an address region "B2" of the recording disc as shown in FIG. 9 (step S405). Recorded in the address region "B2" of the recording disc is a second leading question in the form of video and audio signals for progressing the depth psychological game.

By the execution of the foregoing step S405, the contents of the second leading question are displayed on the display 1 and acoustically output from the speaker 2 at the same time. After the execution of this leading question posing operation, the CPU 10 proceeds to the execution of an answer fetch/correction subroutine at step 406. Since the answer fetch/correction subroutine at this time executes the same flow as that of FIG. 12 explained above, the explanation thereon will be omitted.

After the completion of step S406, the CPU 10 determines whether or not each of the values stored in the address region S in the RAM 12, indicating the answers of the game players, is "0" (step S407). If determining at step S407 that the value is "0", the CPU 10 supplies the LD player 9 with a play command signal for having the LD player 9 play the contents recorded in an address region "D1" on the recording disc as shown in FIG. 9 (step S408). On the other hand, if determining at step S407 that the value is not "0", the CPU 10 supplies the LD player 9 with a play command signal for having the LD player 9 play the contents recorded in an address region "D2" on the recording disc as shown in FIG. 9 (step S409). In the respective address regions "D1" and "D2", first and second evaluation messages for indicating final evaluation results in the depth psychological game are recorded in the form of video and audio signals. Thus, within the first and second evaluation messages, one corresponding to the determination result at step S407 is displayed on the display 1 as well as acoustically output from the speakers 2.

At the aforementioned step S404, if the CPU 10 determines that one of the values stored in the address region S in the RAM 12, indicating the answers of the game players, is not "0", the CPU 10 supplies the LD player 9 with a play command signal for having the LD player 9 play the contents recorded in an address region "B3" on the recording disc as shown in FIG. 9 (step S410). Recorded in the address region "B3" on the recording disc is a third leading question in the form of video and audio signals for progressing the depth psychological game. By the execution of step S410, the contents of the third leading question are displayed on the display 1 as well as acoustically output from the speakers 2. After the execution of this operation, the CPU 10 proceeds to the execution of an answer fetch/correction subroutine at step S411. Since the answer fetch/correction subroutine at this time also executes the same flow as that of FIG. 12 explained above, the explanation thereon will be omitted. After the completion of step S411, the CPU 10 determines whether or not one of the values stored in the address region S in the RAM 12, indicating the answer of the game player, is "0" (step S412). The CPU 10, if determining at step S412 that the value is "0", supplies the LD player 9 with a play command signal for having the LD player 9 play the contents recorded in an address region "D3" on the recording disc as shown in FIG. 9 (step S413). On the other hand, if determining that the value is not "0" at step S412, the CPU 10 supplies the LD player 9 with a play command signal for having the LD player 9 play the contents recorded in an address region "D4" on the recording disc as shown in FIG. 9 (step S414).

Recorded in the respective address regions "D3" and "D4" on the recording disc are third and fourth evaluation messages indicating final evaluation results in the depth psychological game in the form of video and audio signals. Thus, within the third and fourth evaluation messages, one corresponding to the determination result at step S412 is displayed on the display 1 as well as acoustically output from the speakers 2. After completing the execution of either of the above described steps S408, S409, S413 and S414, the CPU 10 fetches the values indicating the numbers of false answers stored in the address region R in the RAM 12 and calculates false answer ratios for the respective game players based on the numbers of false answers, and supplies the LD player 9 with a display command for having the LD player 9 display the false answer ratios (step S415). The CPU 10, after completing step S415, exits the depth psychological game subroutine (step S4) to return to the main operation flow for the information reproducing apparatus as shown in FIG. 6.

At step S3 of the main operation flow, the CPU 10, if determining that the contents stored in the address region L in the RAM 12 is not "1", proceeds to step S5 for executing an affinity forecast game subroutine.

Figure 13:
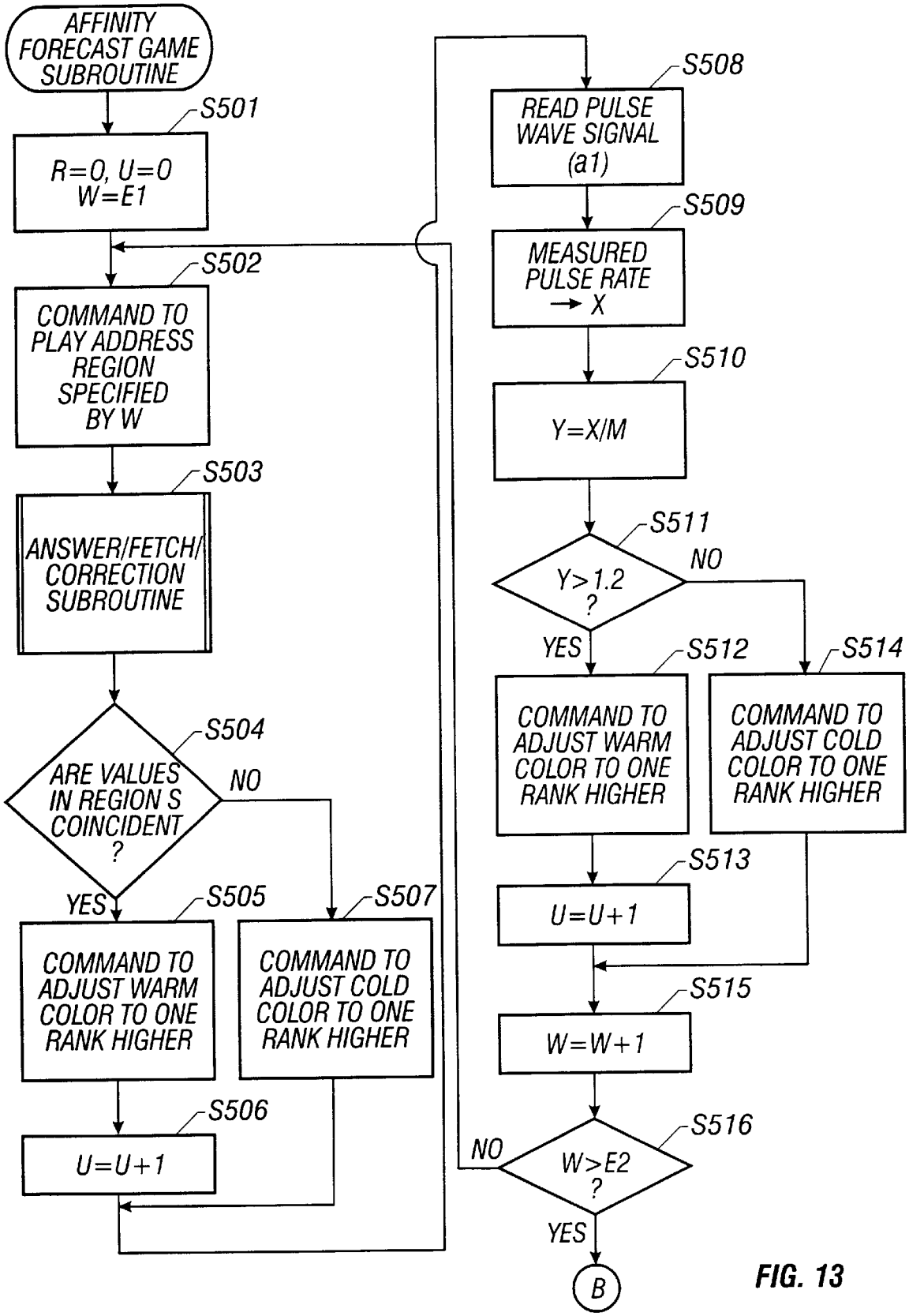
FIGS. 13 and 14 are flow charts each showing an affinity forecast game subroutine in the psychological game machine.
Figure 14:
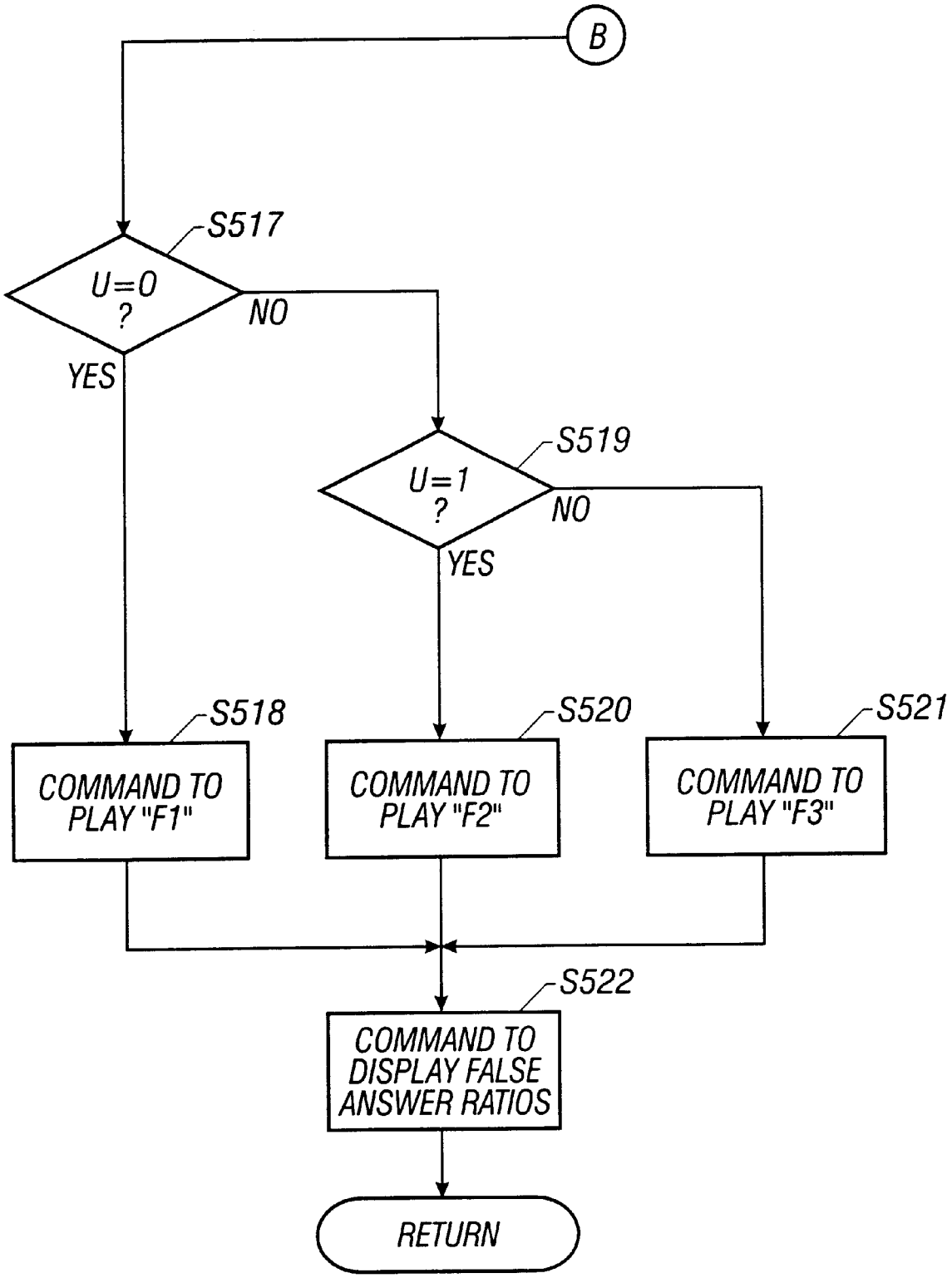

FIG. 13 shows a flow of the affinity forecast game subroutine.

The CPU 10 first resets the contents of the address regions R and U in the RAM 12 shown in FIG. 8 to "0", and sets the contents of an address region W in the RAM 12 to "E1" (step S501). More specifically, by executing step S501, numbers of false answers and an affinity degree of the game players "1" and "2" are respectively set to an initial value equal to "0", and the leading question selecting register for the affinity forecast game is set to "E1". The CPU 10 next reads the contents of the address region W in the RAM 12, and supplies the LD player 9 with a play command signal for having the LD player 9 play the contents recorded in an address region on the recording disc indicated by the address region W (step S502). In this embodiment, in address regions "E1" and "E2" on the recording disc, first and second leading questions are recorded in the form of video and audio signals, respectively, for progressing the affinity forecast game. By the execution of step S502, the contents of the leading question is displayed on the display 1 as well as acoustically output from the speakers 2. After this operation, the CPU 10 executes an answer fetch/correction subroutine at step S503 for both the game players "1" and "2". Since the answer fetch/correction subroutine at this time also executes the same flow as that of FIG. 12 explained above, the explanation thereon will be omitted.

After the completion of the foregoing step S503, the CPU 10 determines whether or not values stored in the address region S in the RAM 12, indicating the answers of the game players "1" and "2" are coincident (step S504). The CPU 10, if determining at step S504 that they are coincident, supplies the LD player 9 with a hue adjustment command signal for emphasizing a warm color in the background image displayed on the display 1 (step S505), and adds "1" to the contents of an address region U in the RAM 12 (step S506). On the other hand, if determining at step S504 that the values are not coincident, the CPU 10 supplies the LD player 9 with a hue adjustment command signal for emphasizing a cold color in the background image displayed on the display 1 (step S507). More specifically, if it is determined at step S504 that the game players "1" and "2" present good affinity (the same answer), the background on the display 1 is painted in a warm color by the LD player 9 to give both the game players "1" and "2" a stimulation which leads the game players "1" and "2" to image good affinity between them. On the contrary, if it is determined at step S504 that the game players "1" and "2" present bad affinity (different answers), the background on the display 1 is painted in a cold color by the LD player 9 to give both the game players "1" and "2" a stimulation which leads them to image bad affinity between them.

After the completion of the foregoing step S506 or S507, the CPU 10 reads pulse wave signals (a1) of the respective game players "1" and "2" sent from the physiological index detector circuit 7 during a predetermined time period T, and stores the respective values of the pulse wave signals (a1) read during the period T into a predetermined address region in the RAM 12 (step S508). Next, the pulse rate per unit time is calculated for each of the game players "1" and "2" based on the values of the pulse wave signals (a1) stored in the predetermined address region in the RAM 12 and the predetermined time period T, and stores the respective pulse rates into an address region X in the RAM 12 (step S509). The CPU 10 next calculates a changing ratio of the pulse rate for each of the game players "1" and "2" based on the initial pulse rate stored in the address region M in the RAM 12 and the pulse rate stored in the address region X in the RAM 12, and stores the calculated changing ratios into an address region Y in the RAM 12 (step S510).

Next, the CPU 10 determines whether or not the changing ratio of the pulse rate is larger than, for example, 120% for each of the game players "1" and "2" (step S511). If determining that the ratio is larger than 120% at step S511, the CPU 10 supplies the LD player 9 with a hue adjustment command signal for emphasizing a warm color on the background image displayed on the display 1 (step S512), and adds "1" to the contents of the address region U in the RAM 12 (step S513). On the contrary, if determining that the ratio is not larger than 120%, the CPU 10 supplies the LD player 9 with a hue adjustment command signal for emphasizing a cold color on the background image displayed on the display 1 (step S514).

After the completion of the foregoing steps S513 or S514, the CPU 10 adds "1" to the contents of the address region W in the RAM 12 (step S515), and determines whether or not the contents of the address region W presents a value larger than "E2" (step S516). If determining at step S516 that the contents of the address region W do not present a value larger than "E2", the CPU returns to step S502 to repetitively execute the operations as described above. It should be noted that "E2" indicates an address corresponding to the last leading question within a plurality of leading questions for the affinity forecast game recorded on the recording disc, as shown in FIG. 9, loaded in the LD player 9. (this embodiment illustratively describes that two leading questions for the affinity forecast game corresponding to "E1" and "E2" have previously been recorded on the recording disc.) In other words, until a plurality of leading questions for the affinity forecast game recorded on the recording disc have been all posed to the game players, the operations at steps S502–S516 are repetitively executed.

In this event, if determining at step S516 that the contents of the address region W present a value larger than "E2", the CPU 10 determines whether or not the value indicating the affinity degree of the game players "1" and "2" stored in the address region U in the RAM 12 is "0" (step S517). If determining that the value is "0" at step S517, the CPU 10 supplies the LD player 9 with a play command signal for having the LD player 9 play the contents recorded in an address region "F1" on the recording disc as shown in FIG. 9 (step S518). On the contrary, if determining at step S517 that the value is not "0", the CPU 10 determines whether the value indicating the affinity degree of the game players "1" and "2" stored in the address region U in the RAM 12 is "1" (step S519). If determining that the value is "1" at step S519, the CPU 10 supplies the LD player 9 with a play command signal for having the LD player 9 play the contents recorded in the address region "F2" on the recording disc as shown in FIG. 9 (step S520). On the contrary, if determining at step S519 that the value is not "1", the CPU 10 supplies the LD player 9 with a play command signal for having the LD player 9 play the contents recorded in an address region "F3" on the recording disc as shown in FIG. 9 (step S521).

In the respective address regions "F1", "F2" and "F3" on the recording disc, first, second and third evaluation messages for indicating final evaluation results for the affinity forecast game are recorded in the form of video and audio signals. Thus, within the first, second and third evaluation messages, a message corresponding to the value stored in the address region U in the RAM 12, i.e., the affinity degree judged to the game players "1" and "2", is selected and displayed on the display 1 as well as acoustically output from the speakers 2. After completing the execution of the above described steps S518, S520 or S521, the CPU 10 fetches the values indicating the numbers of false answers stored in the address region R in the RAM 12, calculates false answer ratios based on the numbers of false answers, and supplies the LD player 9 with a display command for having the LD player 9 display the calculated false answer ratios for the game players "1" and "2" on the display 1 (step S522). The CPU 10, after completing step S522, exits the affinity forecast game subroutine (step S5) as described above, and returns to the main operation flow for the information reproducing apparatus as shown in FIG. 6.

Referring back to FIG. 6, after the completion of the foregoing step S4 or S5, the CPU 10 supplies the printer 5 with a command for printing out the results of the game, thus terminating the operation.

As described above, in the psychological game machine to which the information processing apparatus according to the present invention is applied, changes in physiological indices (GSR value, pulse rate, and so on) of game players are detected while they are playing a game, and stimulation in the form of image and speech is given to the game players in accordance with detected changes in the physiological indices. Further, answers from the game players are determined to be false or not based on such changes in the physiological indices. If it is determined that the answer is not false, a next leading question is presented in accordance with the answer. On the contrary, if the answer is determined to be false, the false answer is forcedly corrected, and then a next leading question in accordance with the corrected answer is presented. The game progresses in this way so as to derive final game evaluation results.

It will be understood that while the answer fetch/correction subroutine shown in FIG. 12 employs the GSR value as a physiological index of game players to perform the "false" determination, the present invention is not limited to such determination based on the GSR value. For example, the answer of a game player may be determined to be false when a sudden change in the pulse rate of the game player is detected.

Also, while the foregoing embodiment illustratively shows a psychological game for determining deep mental state of game players utilizing the nature of the physiological index that changes in accordance with mental changes of the human, the present invention may also be applied to a shooting game in which a game player shoots missiles to destroy targets.

Figure 15:
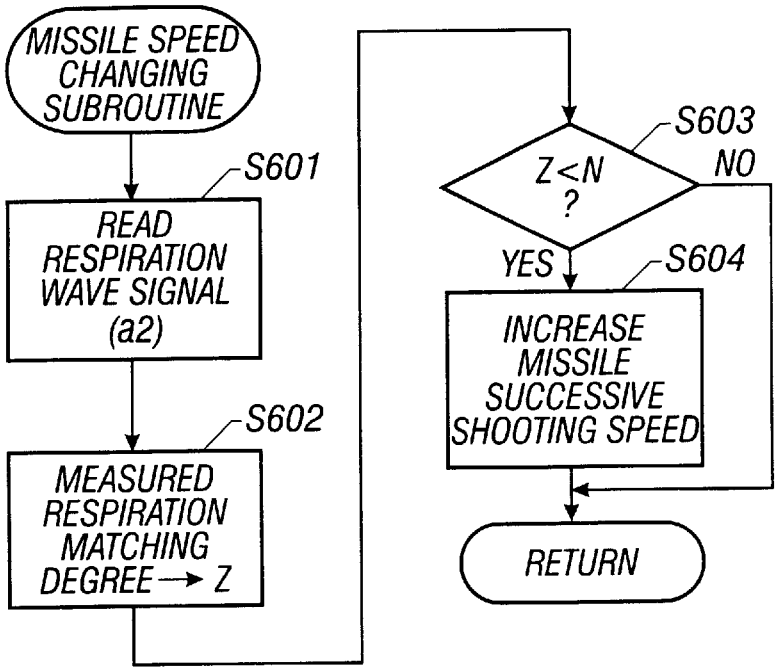
FIG. 15 is a flow chart showing a missile speed changing subroutine.

FIG. 15 shows a flow of a speed changing subroutine for changing the successive missile shooting speed in accordance with physiological indices of game players during a play of a shooting game.

The subroutine is executed every predetermined period during the execution of the shooting game. For the execution of this subroutine, the CPU 10 first reads respiration wave signals (a2) of game players "1" and "2" sent from the physiological index detector circuit 7 during a predetermined time period, and stores the respective values of the respiration wave signals (a2) read during that period into a predetermined address region in the RAM 12 (step S601). The CPU 10 next subtracts the respiration wave signals (a2) of the respective game players "1" and "2" stored in the predetermined address region in the RAM 12 which have been fetched at the same timing, calculates the total sum of absolute values of differences calculated by the subtraction, and stores this total sum as an initial respiration matching degree into an address region Z in the RAM 12 as shown in FIG. 8 (step S602). Then, the CPU 10 determines whether the value stored in the address region Z in the RAM 12 is smaller than the value stored in the address region N in the RAM 12, i.e., the value indicative of the initial respiration matching degree (step S603). If determining at step S603 that the value stored in the address region Z is smaller than the value stored in the address region N, i.e., the initial respiration matching degree, the CPU 10 changes a missile successive shooting speed parameter in order to increase the missile successive shooting speed (step S604). After the execution of step S604, or when determining at step S603 that the value stored in the address region Z is not smaller than the value stored in the address region N, the CPU 10 exits the missile successive shooting speed changing subroutine as described above, and returns to the main flow for executing the shooting game.

In summary, the respiration matching degree of the game players "1" and "2" is measured while they are playing the shooting game, and the missile successive shooting speed is controlled to be increased when the respiration matching degree of both the players during the play becomes larger than the initial respiration matching degree which was measured prior to the start of the shooting game.

While it is assumed in the foregoing embodiment that the number of game players are two, and the progress of the psychological game varies depending on detected physiological changes of both, the progress of the psychological game may vary depending on detected physiological changes of a plurality of two or more game players. Further, the physiological changes may be detected not only for game players who are actually operating the game machine but also for viewers of the game.

In addition, while the foregoing embodiment has been described for the case where the information reproducing apparatus according to the present invention is applied to a game machine, the present invention may also be applied to a cash dispenser or the like so as to operate as a security system.

Figure 16:
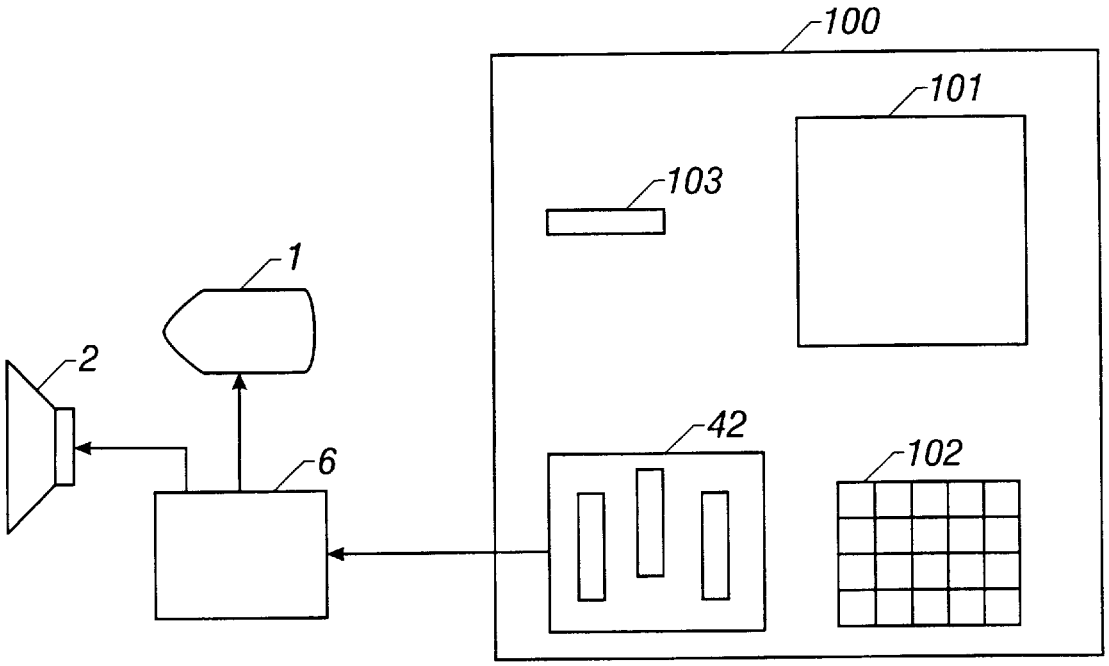
FIG. 16 is a block diagram showing a cash dispenser to which the information reproducing apparatus according to the present invention is applied.

FIG. 16 shows the configuration of a cash dispenser to which the information reproducing apparatus according to the present invention is applied.

As illustrated, an operation table 100 of the cash dispenser is provided with a display 101 for leading a customer to operate the cash dispenser; operation keys 102; and a cash card slot 103. The operation table 100 is further provided with finger electrodes 42 as shown in FIG. 3 for detecting physiological indices from a user. The user operates the operation keys 102 with the right hand while placing finger tips of the left hand on the finger electrodes 42. Electrode signals generated by the finger electrodes 42 are supplied to a system controller 6 as shown in FIG. 2. The system controller 6 measures at any time a GSR value of the user based on the electrode signals supplied from the finger electrodes 42. In this event, if a sudden increase in the GSR value is detected, determining that the user is conducting certain unjust operation, a warning is generated on a display 1 and from a speaker 2 arranged in a guard room.

As described above, the information reproducing apparatus according to the present invention is adapted to select information to be reproduced, based not only on external operations but also on physiological indices of the user performing such external operations and to reproduce the selected information.

Thus, the information reproducing apparatus according to the present invention, when applied to a game machine or the like which performs psychological evaluation, can present leading questions for the psychological evaluation in consideration of not only external operations in accordance with the will of a game player but also physiological indices of the game player, thereby making it possible to evaluate the mental state in the depth of the game player. Also advantageously, the game which progresses variously depending on physiological indices of the game player can realize a psychological evaluation game which will not tire game players.

We claim:

1. An information reproducing apparatus comprising:

physiological value detecting means for detecting a physiological value in the body;

initial value setting means for setting an initial value based on said physiological value detected by said physiological value detecting means;

storing means for storing a plurality of image and audio information items;

operating means for generating an operation signal in response to an external operation;

information reproducing means for extracting at least one of the plurality of image and audio information items stored by said storing means based on a physiological change between a current physiological value detected by said physiological value detecting means and said initial value and the operation signal, and for reproducing the extracted at least one information items; and correcting means for correcting a value of the operation signal based on the physiological change.

2. The information reproducing apparatus according to claim 1 wherein said physiological value detecting means detects a physiological value in each of a plurality of bodies.

3. The information reproducing apparatus according to claim 2, further comprising:

means for performing a calculation of the physiological values from a plurality of bodies detected by the physiological value detecting means.

4. An information reproducing apparatus comprising:

physiological value detecting means for detecting a physiological value in the body;

initial value setting means for setting an initial value based on the physiological value detected by the physiological value detecting means;

a disc-shaped recording medium having a plurality of image and audio information items recorded thereon;

operating means for generating an operation signal in response to an external operation;

information retrieving means for retrieving at least one of the plurality of image and audio information items recorded on the disc-shaped recording medium based on a physiological change between a current physiological value detected by said physiological value detecting means and said initial value and the operation signal;

reproducing means for reproducing the retrieved at least one information item; and correcting means for correcting a value of the operation signal based on the physiological changes.

5. The information reproducing apparatus according to claim 4, wherein the disc-shaped recording medium has a plurality of address regions respectively including a part of the audio and video information items.

6. The information reproducing apparatus according to claim 4, wherein said physiological value detecting means detects physiological values in each of a plurality of bodies.

* * * * *